US008479661B2

(12) United States Patent
Forbes

(10) Patent No.: US 8,479,661 B2
(45) Date of Patent: Jul. 9, 2013

(54) RAILROAD CAR CENTER SILL STRUCTURE

(75) Inventor: James W. Forbes, Campbellville (CA)

(73) Assignee: National Steel Car Limited, Hamilton, Ontario ( * ) Notice: Subject to any disclaimer, the term of this patent is extended or adjusted under 35 U.S.C. 154(b) by 427 days.

(21) Appl. No.: 12/743,299

(22) PCT Filed: Nov. 14, 2008

(86) PCT No.: PCT/CA2008/002028

§ 371 (c)(1),
(2), (4) Date: May 17, 2010

(87) PCT Pub. No.: WO2009/062317

PCT Pub. Date: May 22, 2009

(65) Prior Publication Data

US 2010/0258031 A1 Oct. 14, 2010

Related U.S. Application Data

(60) Provisional application No. 60/988,603, filed on Nov. 16, 2007.

(51) Int. Cl.
*B61D 7/00* (2006.01)
*B61D 17/00* (2006.01)

(52) U.S. Cl.
USPC ..... 105/245; 105/251; 105/416

(58) Field of Classification Search
USPC ..... 105/238.1, 239, 244, 245, 247, 250, 105/251, 396, 404, 406.1, 407, 413–416
See application file for complete search history.

(56) References Cited

U.S. PATENT DOCUMENTS 6,148,735 A * 11/2000 Sauter et al. ..... 105/406.1

FOREIGN PATENT DOCUMENTS

| | | | |
|---|---|---|---|
| CA | 1044519 | A1 | 12/1978 |
| CA | 1054448 | A1 | 5/1979 |
| CA | 2205619 | A1 | 11/1997 |

* cited by examiner

*Primary Examiner* — R. J. McCarry, Jr.
(74) *Attorney, Agent, or Firm* — Hahn Loeser & Parks LLP

(57) ABSTRACT

A rail road car such as a double tub coal gondola car has a center sill that is narrow in the middle between the two tubs, and wider at the draft arms. The center sill has a transition section that provides a smooth, gradual transition between the respective bottom flange portions of the two without sharp changes in direction in the stress fields in tension and compression, and with little or no out of plane eccentricities in load path, and with a tendency to minimize or avoid local stress concentrations. The center sill includes a set of access apertures and corresponding bridges or ties that maintain the lateral halves of the center sill flange main portion in appropriate relationship to each other with respect to resistance to buckling. The tubs fasten mechanically to the sides of the center sill.

21 Claims, 15 Drawing Sheets

-- Prior Art --

-- Prior Art --

RAILROAD CAR CENTER SILL STRUCTURE

FIELD OF THE INVENTION

This invention relates to the field of railroad freight cars, and, in particular to rail road cars having center sills and center sill transitions, of which one example might be a through center sill gondola car.

BACKGROUND

This description relates to the structure of a rail road car underframe, and, in particular, to the assembly of that underframe. Many railroad cars have what are commonly referred to as straight through center sills, as distinguished from stub sills. A straight through center sill runs the full length of the body unit of the car. Often simply the term "center sill" is used when discussing a car with a full center sill.

One type of car that has been known for some years is what is commonly referred to as a bathtub gondola car. In a traditional gondola car the floor or deck of the gondola is a substantially flat sheet (or assembly of sheets) that is carried at roughly the level of the top flange of the center sill, above a set of cross-bearers and cross ties. In a bathtub car, the floor of the gondola is not flat, but rather bulges downwardly between the sidebeams. To some people, the downwardly bulging lading containment skin bears a resemblance to a bath tub. In one particular type of bathtub gondola car, there are two parallel "tubs", each of the two tubs being mounted between the center sill and a respective one of the side sills of the side beams of the car. An example of such a double tub gondola is shown in U.S. Pat. No. 4,361,097 of Jones, issued Nov. 30, 1982. In this car, the center sill functions both to provide a vertical load path for the tubs and to provide a longitudinal path for buff and draft loads. In the first role, it may be noted that coal car tubs (and other fittings) are sometimes made of materials other than steel. For example, the tubs and portions of the sidewalls may be made of aluminum. Some of the sidewall sheets may be made of stainless steel.

SUMMARY OF THE INVENTION

In an aspect there of the invention there is a rotary dump double tub gondola car that has a center sill that includes draft arms at either end of the car and a central portion running between the draft arms. The draft arms each have a bottom flange that is wider than the bottom flange of the central portion generally. The center sill includes a transition plate that is narrow at one end, and wide at the other for placement at the ends of the central portion of the center sill. The transition portions provide an in-plane longitudinal stress field connection between the narrower and wider portions of the bottom flange of the center sill.

In another aspect of the invention, there is a center sill assembly for a railroad freight car. The center sill assembly includes a first portion and a second portion. The first portion includes a draft arm in which to mount draft gear and a coupler. The first portion has a top flange, a bottom flange, a first side web and a second side web, the top flange, bottom flange, and first and second side webs co-operating to define a substantially rectangular tube. The draft arm has a first end and a second end, the second end of the draft arm having a striker plate thereat, the first end of the draft arm having an internal peripheral boss formed thereat, and the draft arm having a center plate mounted to the bottom flange thereof closer to the first end than to the second end, the internal peripheral boss extending lengthwise proud of the bottom flange at the first end of the draft arm. The bottom flange of the draft arm has a continuous full width portion between the center plate and the first end, the full width portion having an extent $W_2$. The second portion of the center sill assembly includes a top flange, a bottom flange, a first side web and a second side web, the top flange the bottom flange, and the first and second side webs co-operating to define a substantially rectangular tube, the bottom flange including a main portion and a transition portion, the transition portion lying between the main portion and the bottom flange of the draft arm. On assembly, the boss of the draft arm fits within the substantially rectangular tube of the second portion of the center sill assembly, and the substantially rectangular tube of the second portion of the center sill assembly mates in abutting engagement with the first end of the draft arm. The main portion has an overall flange width $W_1$, $W_2$ being greater than $W_1$. The transition portion has a first end mating with the main portion, and a second end mating with the first end of the bottom flange of the draft arm. The transition portion widens from the main portion toward the draft arm. The main portion of the bottom flange of the second portion of the center sill assembly, the transition portion of the bottom flange of the second portion of the center sill assembly, and the bottom flange of the first portion of the center sill assembly are all substantially co-planar, whereby an in-plane stress path is provided between the bottom flanges of the first and second portions of the center sill assembly.

In a feature of that aspect of the invention, the main portion of the bottom flange of the first portion of the center sill, the transition portion of the bottom flange of the first portion of the center sill, and the bottom flange of the draft arm are all of the same through thickness. In another feature, the main portion of the center sill is of constant thickness. In a further feature, the bottom flange of the main portion of the center sill has margins extending transversely proud of the first and second webs of the main portion. In still another feature, the main portion of the bottom flange of the second portion of the center sill has an array of access apertures formed therein between the first and second side webs. In another feature, said transition portion of said bottom flange has a length, L, and a change in width dW from the narrow end to the wide end, and a ratio of L:dW is greater than 3:1. In a further feature L:dW is one of (a) about 4:1; and (b) more than 4:1. In yet a further feature, the car includes at least one lading containment tub running beside part of the second portion of the center sill, and the tub has an arcuate bottom wall having a margin mechanically fastened to one side web of the second portion of the center sill.

In another aspect of the invention there is a rail road gondola car having a center sill and a pair of first and second side beams spaced to either side of the center sill and running parallel thereto. The gondola car has a pair of first and second tubs mounted to either side of the center sill. Each tub runs lengthwise parallel to the center sill. Each tub has an arcuate bottom containment member, the arcuate bottom containment member having a margin attached by mechanical fasteners to the center sill. The center sill has a bottom flange that has an array of access apertures formed therein by which to install the fasteners, the bottom flange also including an array of lateral bridging members.

In another aspect of the invention there is a center sill assembly for a rail road freight car. The center sill assembly has a U-shaped channel of constant cross-section, oriented with legs downward. A bottom flange is welded across the legs of the U-shaped channel section. The U-shaped channel extends both inboard and outboard of at least one center plate for seating on a rail road car truck. The bottom flange includes a narrow portion, a wide portion, and a transition portion placed longitudinally between the wide portion and the narrow portion. The narrow portion, the wide portion and the transition are substantially co-planar.

In a feature of that aspect of the invention, at least two of (a) the narrow portion; (b) the wide portion; and (c) the transition portion are made from a single monolithic piece of stock. In another feature the transition portion is of the same thickness as at least one of (a) the wide portion; and (b) the narrow portion. In still another feature the channel section has first and second ends, and a respective striker is mounted at each of the ends. In a further feature the center sill assembly is part of a railroad freight car, and at least one of (a) the bottom flange is a monolith from one end of the freight car to the other; and (b) the channel section is a monolith from one end of the freight car to the other. In still another feature, the center sill has a center plate mounted to the wider portion, and is intersected by a bolster abreast of the center plate. In yet another feature the assembly includes an array of access apertures formed in the narrow portion of the bottom flange.

In yet still another feature of that aspect of the invention, the center sill assembly is one in which any one of: (a) the U-shaped channel is formed from a single monolith; (b) the U-Shaped channel runs the full length of the car from striker to striker; (c) at least two of (i) the narrow portion of the bottom flange; (ii) the wide portion of the bottom flange; and (iii) the transition portion of the bottom flange are made from a single monolith; (d) the channel has internal webs that provide web continuity for a main bolster across the channel, and the bottom flange has a center plate fitting mounted thereto centrally with respect to the internal webs and the channel; (e) the transition section has a length L, that is between 3/2 and 4 times the width of the channel measured across the outside of the channel legs; (f) the transition section has a length, L, that is between 3/2 and 3 times the height of the channel; (g) the transition section has a length, L, that is between 5/2 and 5 times the change in overall bottom flange width of the transition; (h) the U-shaped channel has ends having slots formed therein to accept a coupler shank key; (i) the bottom flange has a bifurcated portion longitudinally outboard of the center plate for accepting installation of draft gear therethough, and fittings by which to attach a draft gear carrier; (j) the channel has an internal dimension for receiving draft gear of standard AAR dimensions; and (k) the bottom flange has an array of apertures formed therein to provide internal access to the channel. In a further feature, the assembly includes any combination of items (a) to (k). In a still further feature, the assembly includes all of items (a) to (k).

These and other aspects and features of the invention may be understood with reference to the description which follows, and with the aid of the illustrations.

BRIEF DESCRIPTION OF THE FIGURES

The description is accompanied by a set of illustrative Figures in which.

DETAILED DESCRIPTION

Figure 1A:
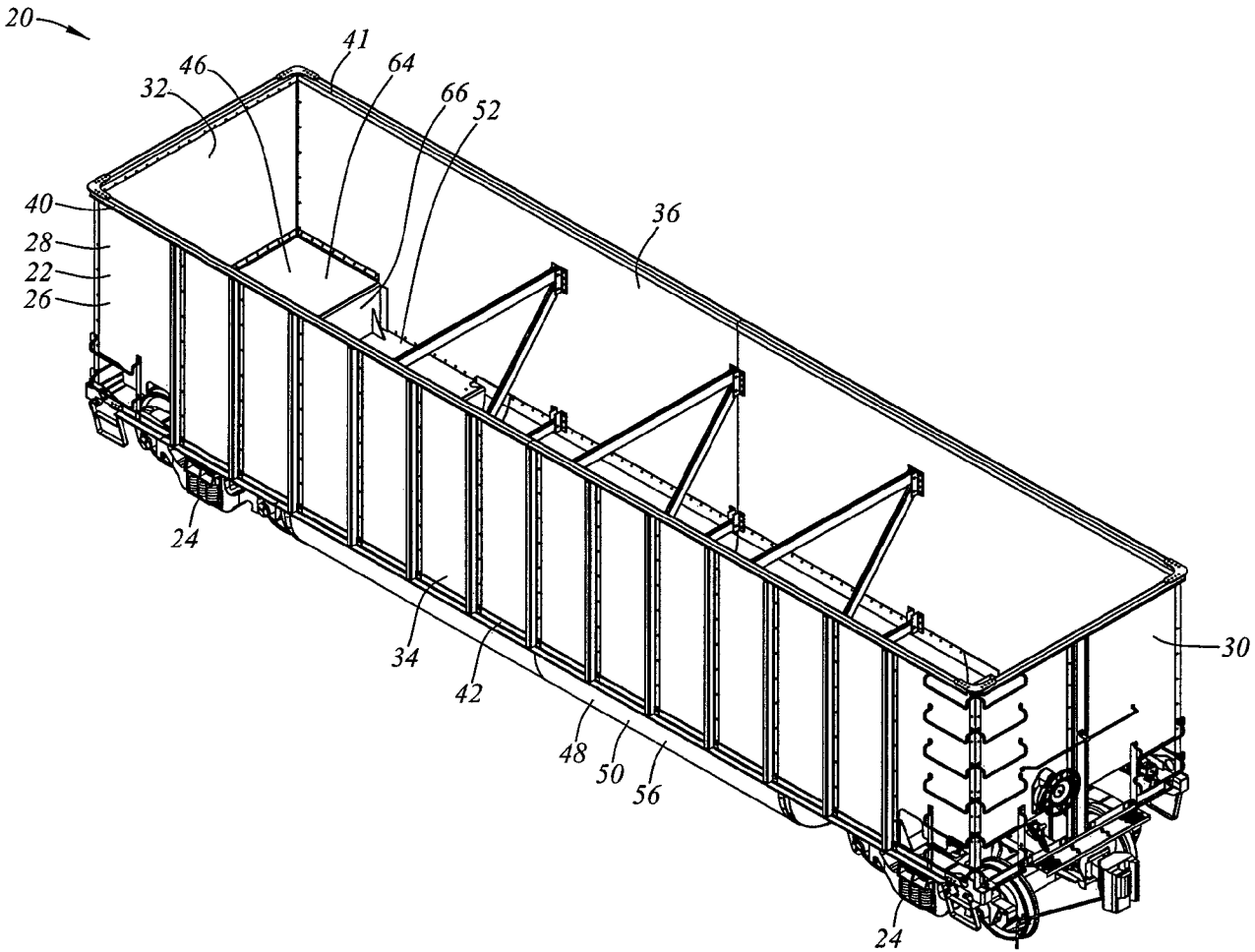
FIG. 1*a* is a general arrangement, isometric view of a railroad freight car such as a bathtub gondola car that may incorporate the various aspects of the present invention, the view being taken from above and to one diagonal corner.
Figure 1B:
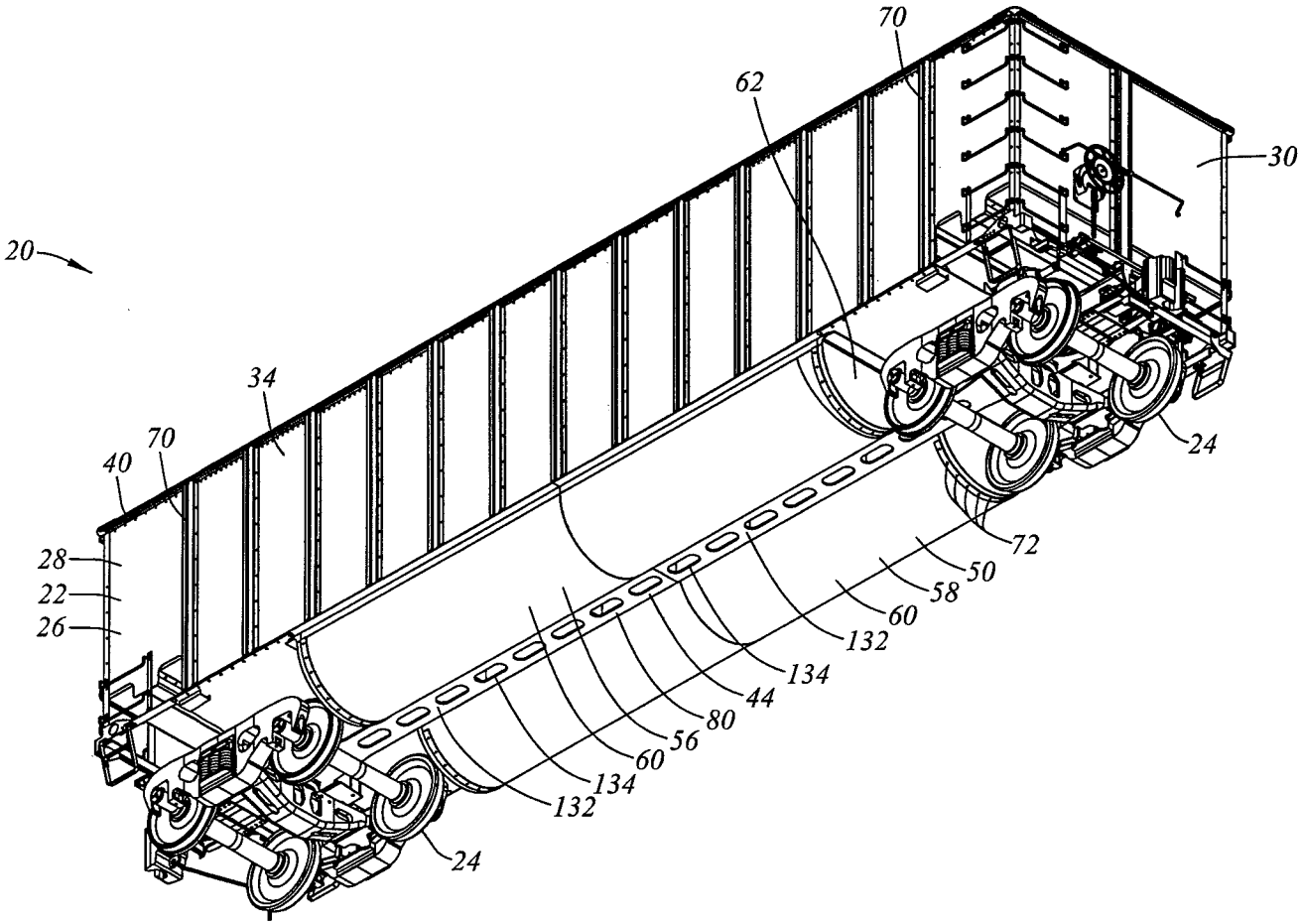
FIG. 1*b* is a general arrangement, isometric view of a the railroad freight car of FIG. 1*a* taken from below at that diagonal corner.
Figure 1C:
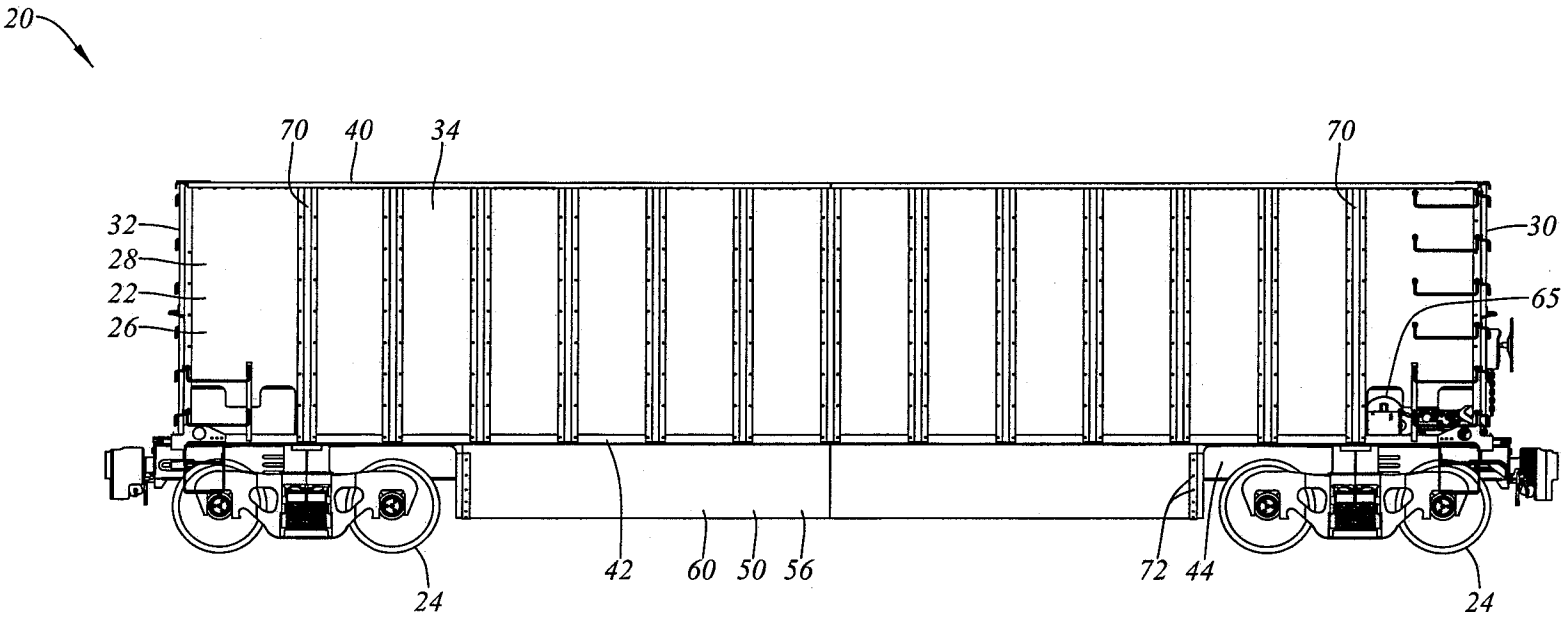
FIG. 1*c* is a side view of the railroad car of FIG. 1*a;*
Figure 1D:
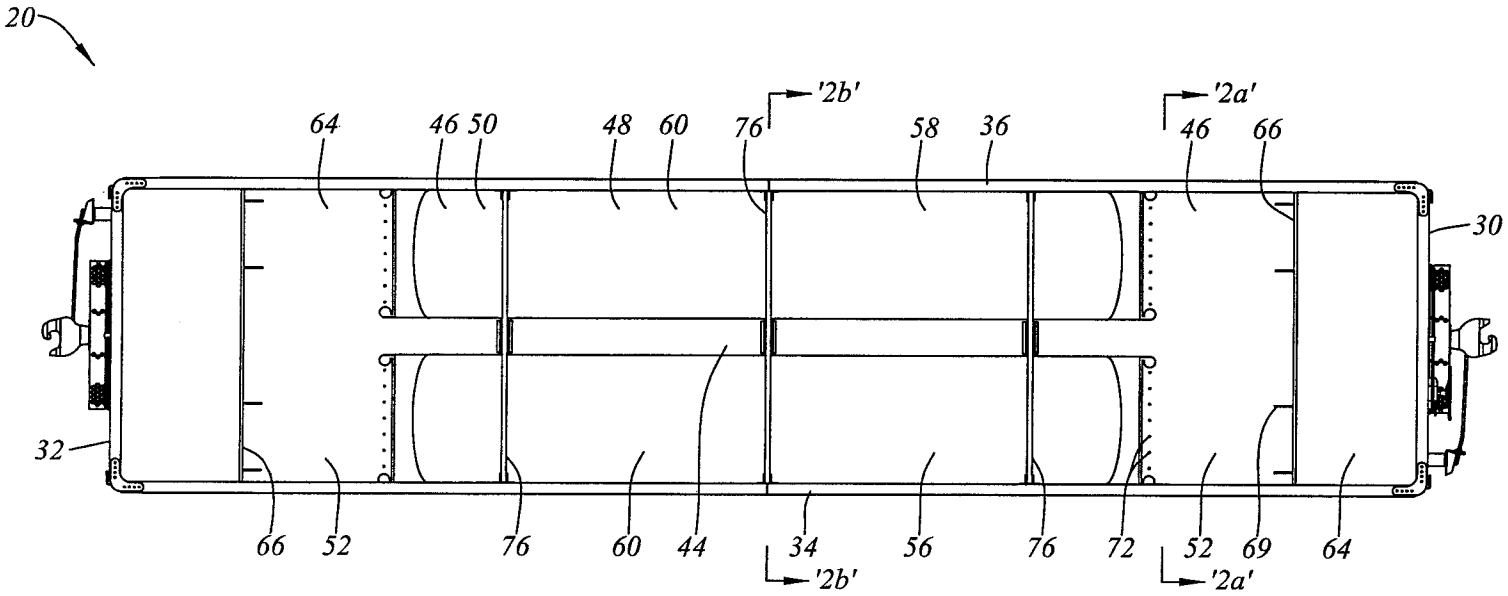
FIG. 1*d* is a top view of the railroad car of FIG. 1*a;*

The description that follows, and the embodiments described therein, are provided by way of illustration of an example, or examples, of particular embodiments of the principles, aspects or features of the present invention. These examples are provided for the purposes of explanation, and not of limitation, of those principles and of the invention. In the description, like parts are marked throughout the specification and the drawings with the same respective reference numerals. The drawings are generally to scale unless noted otherwise.

The terminology used herein is thought to be consistent with the customary and ordinary meanings of those terms as they would be understood by a person of ordinary skill in the railroad industry in North America at the date of filing, and particularly as would be understood on the basis of pertinent rules, specification, standards, practices and regulations of the Association of American Railroads, (the AAR), which may be referred to and relied upon as if incorporated herein by reference. Following from the decision of the CAFC in Phillips v. AWH Corp., the Applicant expressly excludes all interpretations that are inconsistent with this specification. In particular, to confine the rule of broadest reasonable interpretation to interpretations that are consistent with actual usage in the railroad industry as understood by persons of ordinary skill in the art, or that are expressly supported by this specification, the inventor expressly excludes any interpretation of the claims or the language used in this specification such as may be made in the USPTO, or in any other Patent Office, other than those interpretations for which express support can be demonstrated in this specification or in objective evidence of record, as discussed in In re Lee, (for example, earlier publications by persons not employed by the USPTO or any other Patent Office), demonstrating how the terms are used and understood by persons of ordinary skill in the art, or by way of expert evidence of a person or persons of at least 10 years experience in the railroad industry in North America or in other territories or former territories of the British Empire and Commonwealth. In all cases, meanings or definitions based on AAR Rules, specifications or procedures or definitions provided in railroad specific dictionaries such as *Railway Age's Comprehensive Railroad Dictionary* (Simmons-Boardman, Omaha, 1984) shall take precedence over, and, in case of any disagreement shall exclude, any interpretation advanced by the USPTO or any other Patent Office.

In terms of general orientation and directional nomenclature, for railroad cars described herein the longitudinal direction is defined as being coincident with the rolling direction of the railroad car, or railroad car unit, when located on tangent (that is, straight) track. In the case of a railroad car having a center sill, the longitudinal direction is parallel to the center sill, and parallel to the top chords. Unless otherwise noted, vertical, or upward and downward, are terms that use top of rail, TOR, as a datum. In the context of the car as a whole, the term lateral, or laterally outboard, or transverse, or transversely outboard refer to a distance or orientation relative to the longitudinal centerline of the railroad car, or car unit, or of the centerline of a center plate at a truck center. The term "longitudinally inboard", or "longitudinally outboard" is a distance taken relative to a mid-span lateral section of the car, or car unit. Pitching motion is angular motion of a railcar unit about a horizontal axis perpendicular to the longitudinal direction. Yawing is angular motion about a vertical axis. Roll is angular motion about the longitudinal axis. Given that the railroad car described herein may tend to have both longitudinal and transverse axes of symmetry, a description of one half of the car may generally also be intended to describe the other half as well, allowing for differences between right hand and left hand parts. In this description, the abbreviation kpsi stands for thousand of pounds per square inch. To the extent that this specification or the accompanying illustrations may refer to standards of the Association of American Railroads (AAR), such as to AAR plate sizes, those references are to be understood as at the earliest date of priority to which this application is entitled.

FIG. 1*a* shows an isometric view of an example of a railroad freight car 20 that is intended to be representative of a wide range of railroad cars in which the present invention may be incorporated. While car 20 may be suitable for a variety of general purpose uses, it may be taken as being symbolic of, and in some ways a generic example of, a freight car having a straight through center sill. It may be a gondola car, in which lading is introduced by gravity flow from above. The gondola car may be a rotary dump gondola, and, in particular, may be a bathtub, or twin bathtub, gondola car as illustrated. Other than ancillary fittings, the structure of car 20 may tend to be symmetrical about both its longitudinal and transverse, or lateral, centreline axes.

By way of a general overview, car 20 may have a car body 22 that is carried on trucks 24 for rolling operation along railroad tracks. Car body 22 may typically be of all welded steel construction, or may be of mixed construction that may include two or more of mild steel, aluminum, stainless steel and composites. Car 20 may be a single unit car, or it may be a multi-unit car having two or more car body units, where the multiple car body units may be connected at an articulated connector, or by draw bars. In gondola cars the density of the lading may typically require that multi-unit cars be connected by draw bars rather than articulated connectors. Car body 22 may have a lading containment vessel, or structure, or shell 26. Shell 26 may include a generally upstanding wall structure 28 which may include a pair of opposed first and second end walls 30, 32, that extend cross-wise, and a pair of first and second deep side beam assemblies or wall assemblies, that may be identified as sidewalls 34, 36 that extend lengthwise. The end walls 30, 32 and side walls 34, 36 co-operate to define a generally rectangular form of peripheral wall structure 28, when seen from above. Wall structure 28 may include top chords 40, 41 running along the top of sidewalls 34, 36, and side sills 42, 43 running fore-and-aft along lower portions of side walls 34, 36. In some instances side walls 34, 36 may act as deep beams, and may carry vertical loads to the main bolsters 68 that extend laterally from the center plates 45. Center plates 45 seat in the center plate bowls of trucks 24. Car 20 includes a straight-through center sill 44, running from one end of the car body to the other. In the case of a single, stand alone car unit, draft gear and releaseable couplers may be mounted at either end of the center sill.

The containment structure may include a bottom, floor or deck, indicated generally as 50. This floor or deck discourages downward escape of the lading. It may include end portions 46 and a central or intermediate portion 48. End portions 46 may include a substantially planar shear plate 52 that runs between the bottom chords of the side sills 42, 43, typically at the level of the top flange of the center sill and the top flanges of the arms 54 of the main bolster. Shear plate 52 extends over the truck longitudinally inboard of the truck centers. The central or intermediate portion 48 lies between, and clear of, trucks 24 and may include first and second tubs 56, 58 that extend downwardly of the level of the center sill top flange and downwardly of the side sills. The tubs include curved tub sheets 60, and intermediate tub end bulkheads 62 that meet shear plate 52.

The deck may also include a raised end or "mezzanine" portion, or step deck 64 that extends longitudinally outboard of the main bolster and runs to the end wall of the car. The brake reservoir 65 and various brake fittings are mounted at the 'B' end of the car beneath this raised deck portion. There is a stub wall 66 that extends in a vertical plane above the central web of the main bolster 68. Main bolster 68 is a stub bolster that extends only partially outboard, sufficient for the transversely outboard ends of main bolster 68 to overlie the side bearings of truck 24. Stub wall 66 defines the web of what is, in essence, a Z-section, whose flanges are provided by shear plate 52 and step deck 64. This Z-section beam runs fully across the car, with stub wall 66 lying in the same vertical plane as the centerlines of the main posts 70 of the side beams, namely sidewalls 34, 36. Inasmuch as stub wall 66 is also in the same vertical plane as the central web of bolster 68, this provides a load path for vertical loads in the side beams to be carried into the center plate. Reinforcement gussets 69 are mounted directly above, and in the same plane as the web gussets of bolster 68 and provide web continuity to those gussets above and below shear plate 52. Gussets 69 extend upwardly along, and provide a vertical shear connection into, stub wall 66.

Tub sheets 60 may be made of mild steel, aluminum, or stainless steel. One inventor has suggested the use of a composite sheet of Kevlar™ (see U.S. Pat. No. 5,373,792, of Pileggi, issued Dec. 20, 1994). The tub sheets may be held in place by mechanical fasteners 72 at side sills, end bulkheads 62 and at center sill 44. Those mechanical fasteners 72 may include plastically deformable clinching members such as rivets or Huck™ bolts. In the middle or intermediate portion of the car between the trucks where the tubs are located, the car may also include cross-ties 74 extending laterally from rib plate 77 mounted to center sill 44 at the level of the side sills, upper cross-ties 76 mounted in an upper region of the car generally close to the top chords and running from sidewall to side wall, and diagonal braces 78 extending from the center sill to the junction bracket 79 at which cross-ties 76 are secured to the sidewalls 34, 36. In a general sense, sets of cross-ties 76, cross-ties 78 and diagonal braces 78 may tend to lie in a vertical plane perpendicular to the longitudinal axis of the car more generally.

Figure 1E:
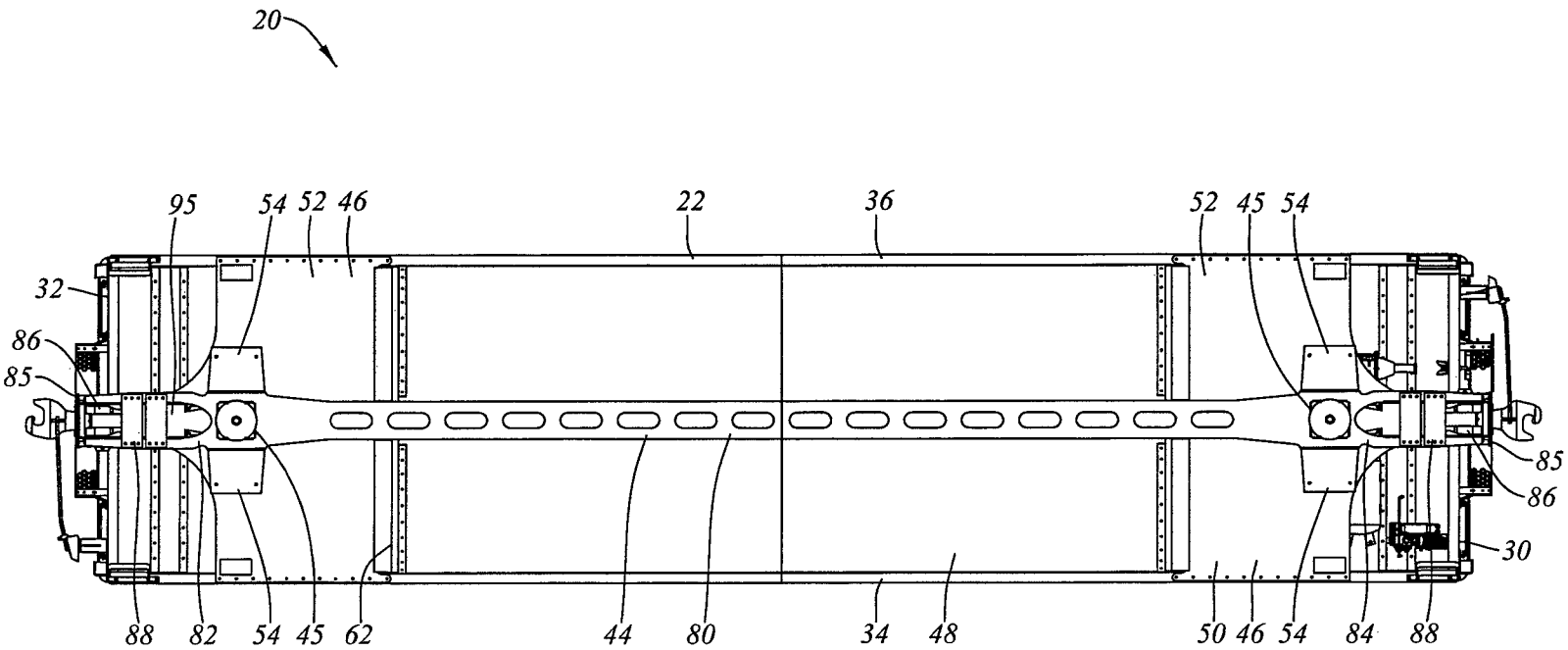
FIG. 1*e* is a bottom view of the railroad car of FIG. 1*a;*
Figure 1F:
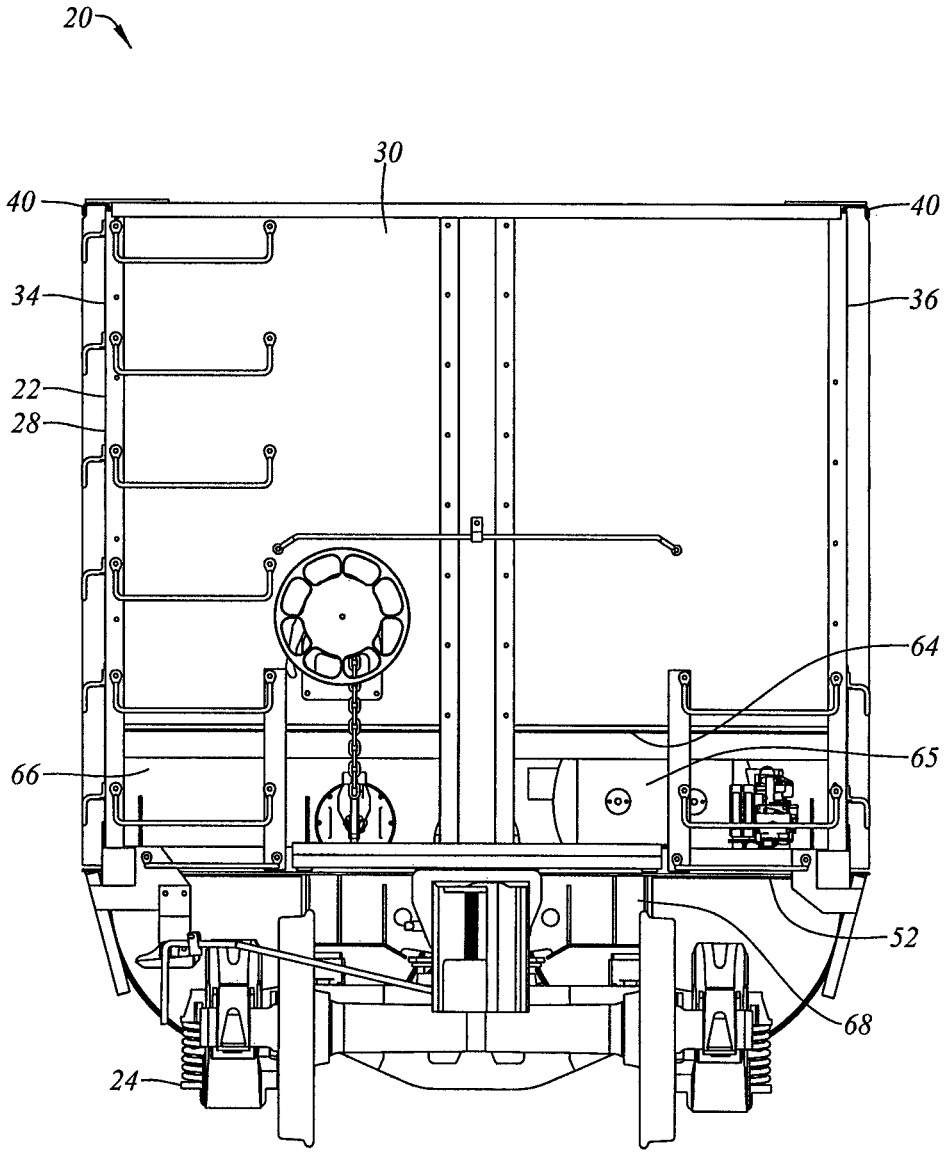
FIG. 1*f* is an end view of the railroad car of FIG. 1*a;*
Figure 2A:
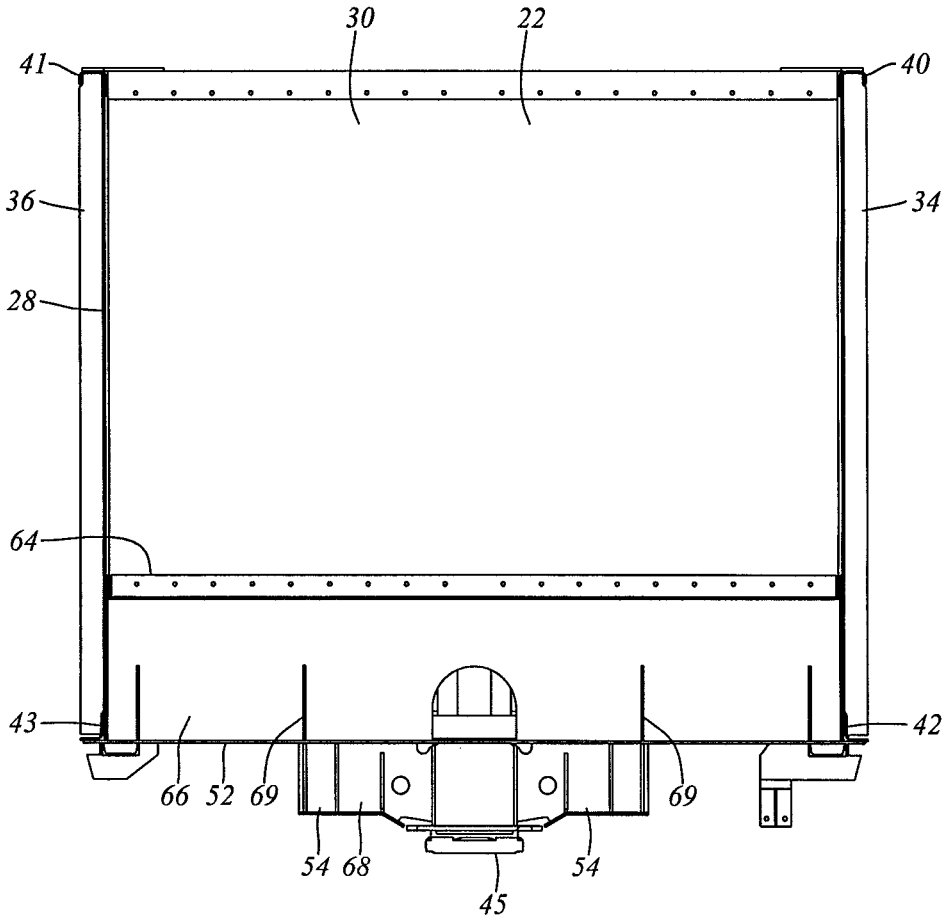
FIG. 2*a* is a transverse sectional view of the railroad freight car of FIG. 1*a* taken on section '2*a*-2*a*' of FIG. 1*d* looking longitudinally outboard.
Figure 2B:
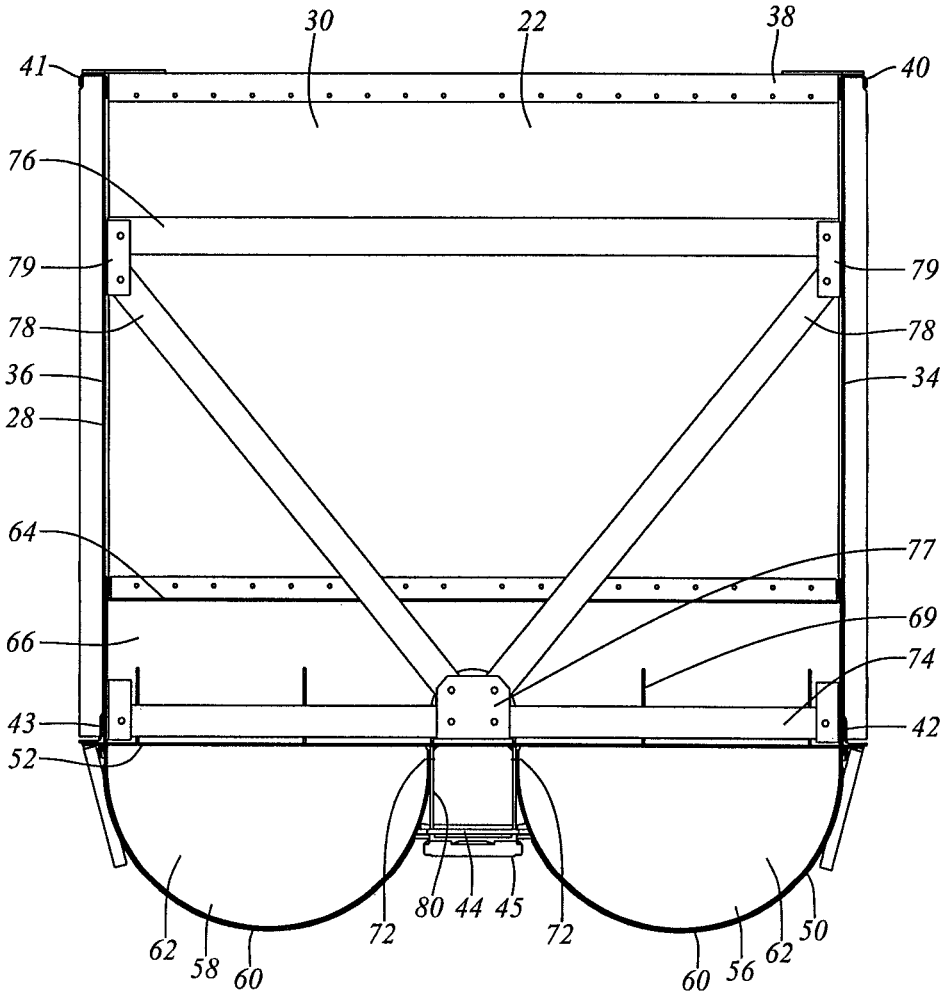
FIG. 2*b* is a transverse sectional view of the railroad freight car of FIG. 1*a* taken on section '2*b*-2*b*' of FIG. 1*d;*

Part of center sill 44 is shown in FIGS. 3*a*-3*d* in greater detail. It may be noted that in FIGS. 3*a* and 3*b* center sill 44 is shown upside down, or, expressed differently, is viewed from the bottom looking upward. Center sill 44 includes three primary components, those components being an intermediate or central center sill portion 80 and two center sill end portions indicated generally as draft arms 82, 84. Center sill end portions 82, 84 are the same, and may be pre-fabricated center sill draft arms, which may be integrally formed, monolithic (i.e., single piece) castings. Each single piece casting may include at its longitudinally outboard end a striker plate, 85, a draft pocket 86, and fittings (e.g., fastener bore arrays) 87 for draft gear carrier plates 88 (see FIG. 1*e*), and so on. The draft arm 82 (or 84) may also include the center plate 45. The draft arms 82, 84 may have the general form of a rectangular tube having a top flange 90, a bottom flange 92, and respective side webs 94, 96 extending between the top an bottom flanges 90, 92. The spacing of those webs and flanges defines accommodations corresponding to standard AAR sizes for draft gear and couplers. Bottom flange 92 has a large slot 95 running inboard of the striker plate to permit the installation of the draft stops and draft gear. Whereas top flange 90 may have an overall width generally corresponding to the spacing of webs 94, 96, bottom flange 92 may have laterally extending toes that extend substantially wider than webs 94, 96. The draft arms may also have bosses, or shoulders, 98 at which the arms of main bolster 68 attach. The width of the bottom flange longitudinally inboard of center plate 45 is shown as $W_2$.

The inboard end of the draft arm 82, 84 may have a longitudinally extending internal peripheral male wall, or boss 100, and an associated peripheral shoulder, 102. This boss fits inside the corresponding female socket, indicated generally as 104 defined by the center sill middle, or intermediate portion 80.

Intermediate portion 80 may also include a bottom flange 106, a top flange 108 and a pair of webs 110, 112, all of which combine to form a closed box section. The spacing between the top and bottom flanges 106, 108 and the spacing between the respective side webs corresponds to the spacing of the flanges and webs of the draft arms such that the opening between the various members defines female socket 104.

In one embodiment the center portion of the center sill includes a three-sided channel 120 that defines the top flange 106 and side webs 110, 112 of the center sill. Channel 120 may be a U-pressing. It may, alternatively, be roll formed. Bottom flange 108 is defined by a plate 122 welded across the ends of the toes of the channel so formed, with a full continuous longitudinal fillet weld made between the ends of the toes and the upper surface of the transversely extending overlapping edge of the bottom flange, as at 125. Such a continuous, straight, well exposed, level, weld may be made by an automated welding machine with reasonable consistency. At the ends of channel 120, bottom flange 108 includes transition portions 124, which may have a trapezoidal shape. In the central portion of the car, the bottom flange is only marginally wider overall than the outside dimension of the center sill measured across the webs, such as may allow clearance for the arcuate tub bottom sheets 60. This width is indicated as $W_1$. The bottom flange widens longitudinally outboard of the internal bulkheads 62 to the same width as the bottom flange of the draft arm. The medium of this widening from $W_1$ to $W_2$ is transition plate 124.

On assembly center sill portion 80 meets center sill end portion 82 (or 84 as may be) at a mutually engaging socket connection. The internal, peripherally extending boss 100 also functions as a backing bar for a full penetration bevel weld that extends fully about the periphery of the center sill junction. Furthermore, a full width weld is made across the bottom flange connection over the full width $W_2$ of the flanges at this location.

Thus there is a center sill assembly for a rail road freight car. The center sill assembly has a first portion and a second portion. The first portion includes a draft arm in which to mount draft gear and a coupler. The first portion has a top flange, a bottom flange, a first side web and a second side web. The top flange, bottom flange, and first and second side webs co-operate to define a substantially rectangular tube. The draft arm has a first end and a second end. A striker plate, or, colloquially, the striker, is mounted at the second end of the draft arm. An internal peripheral boss is formed at the first end of the draft arm, which is the longitudinally inboard end. The boss might also be termed a plug. The boss, or plug, is smaller in height and width than the open end of the second portion of the center sill assembly. The draft arm has a center plate mounted to the bottom flange thereof. The center plate is closer to the first end (i.e., the longitudinally inboard end) of the draft arm than to the second end (i.e., the striker end). The internal peripheral boss extends lengthwise proud (i.e., longitudinally inboard) of the bottom flange at the first end of the draft arm. The bottom flange of the draft arm has a continuous full width portion between the center plate and the first end, the full width portion has an extent $W_2$. The second portion of the center sill assembly includes a top flange, a bottom flange, a first side web and a second side web. The top flange, the bottom flange, and the first and second side webs co-operate to define a substantially rectangular tube. The bottom flange includes a main portion and a transition portion. The transition portion lies between the main portion of the bottom flange of the transition portion and the longitudinally inboard end of the bottom flange of the draft arm.

On assembly, the boss of the draft arm fits within the substantially rectangular tube of the second portion of the center sill assembly, and the substantially rectangular tube of the second portion of the center sill assembly mates in abutting engagement with the first end of the draft arm. The main portion of the bottom flange of the second, or central, portion of the center sill assembly has an overall flange width $W_1$, $W_2$ is greater than $W_1$.

The transition portion of the bottom flange has a first end mating with the main portion of the bottom flange, and a second end mating with the first end (i.e., the longitudinally inboard end) of the bottom flange of the draft arm. The transition portion widens from the main portion toward the draft arm. The main portion of the bottom flange of the second portion of the center sill, the transition portion of the bottom flange of the second portion of the center sill assembly, and the bottom flange of the first portion of the center sill assembly all are substantially co-planar, whereby a substantially in-plane stress path is provided between the bottom flanges of the first and second portions of the center sill assembly. These bottom flange portions may all be of the same thickness or may be of different thicknesses. For example, the main portion of the bottom flange may be as thin as ½ inch (12 to 13 mm), as for example, where a solid continuous flange section is employed, and as thick as ¾ inch (19-20 mm), as, for example, where the bottom flange includes an array of slots. The draft arm bottom flange section may typically be ¾ inch thick.

Substantially co-planar means that, in a wider range, the central through thickness plane (the neutral plane) of the thinner member lies in a plane that is within the height range defined by the planes of the top and bottom surfaces of the thicker member. In a narrower range, (a) either the top surfaces of the flange portions are co-planar, or (b) the bottom flanges are co-planar, or (c) the top surface of the thinner portion is shy of the plane of the top flange of the thicker flange portion, and the bottom surface of the thinner portion is shy of the bottom surface of the thicker portion, such that the thinner portion lies between two planes defined by the respective upper and lower surfaces of the thicker portion of the bottom flange. The thicker portion may typically be the draft arm bottom flange portion.

In one embodiment, the main portion of the bottom flange of the first portion of the center sill, the transition portion of the bottom flange of the first portion of the center sill, and the bottom flange of the draft arm are all of the same through thickness. The center sill assembly is of constant thickness. The bottom flange of the main portion of the center sill assembly has margins that extend transversely proud of the first and second webs of the main portion. The main portion of the bottom flange of the second portion of the center sill assembly has an array of access apertures formed therein between the first and second side webs of the U-shaped channel.

In one embodiment, there is a railroad gondola car that incorporates the center sill assembly described above. The railroad car includes at least one lading containment tub running beside part of the second portion of the center sill, and the tub has an arcuate bottom wall has a margin mechanically fastened to one side web of the second portion of the center sill assembly.

The illustrations have shown a rail road gondola car that has a center sill and a pair of first and second side beams spaced to either side of the center sill and running parallel thereto. The gondola car has a pair of first and second tubs mounted to either side of the center sill. Each tub runs lengthwise parallel to the center sill. Each tub has an arcuate bottom containment member. The arcuate bottom containment member has a margin attached by mechanical fasteners to the center sill. The center sill has a bottom flange that has an array of access apertures formed therein by which to install the fasteners. The bottom flange also includes an array of lateral bridging members as described.

Figure 3A:
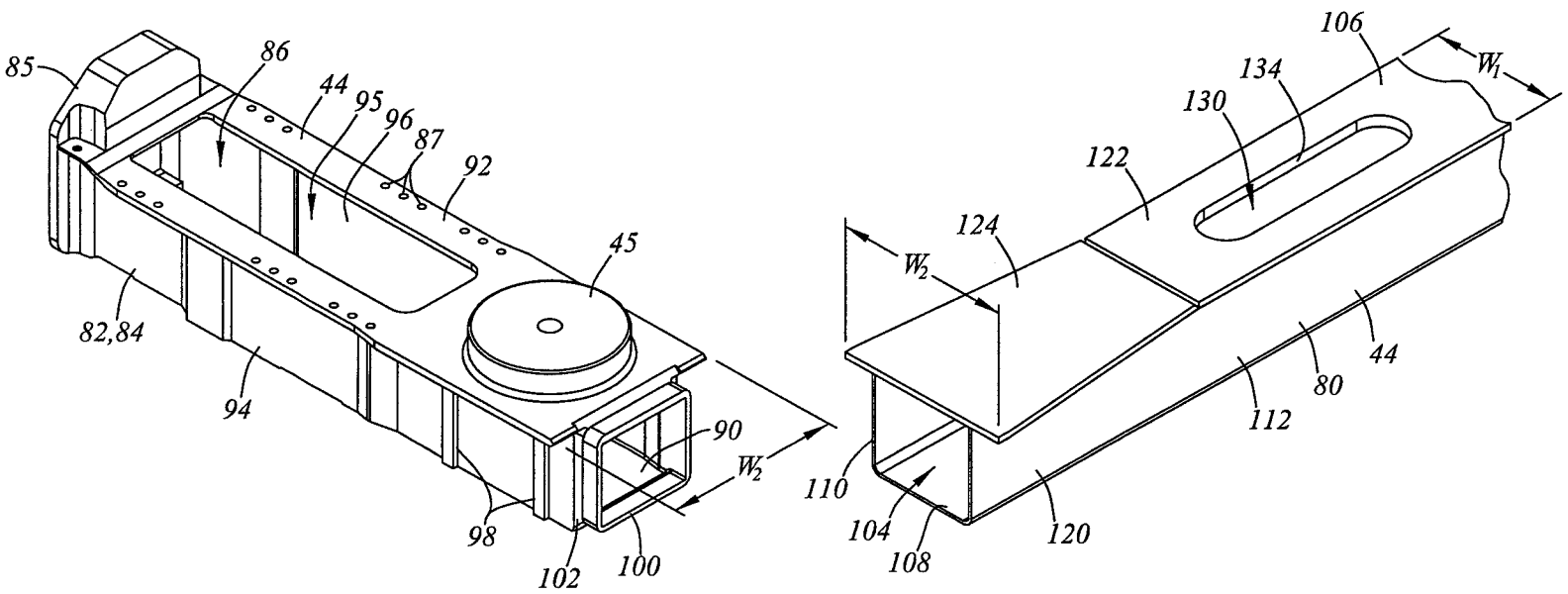
FIG. 3*a* is a separated view of two elements of the center sill of the railroad car of FIG. 1*a;*
Figure 3B:
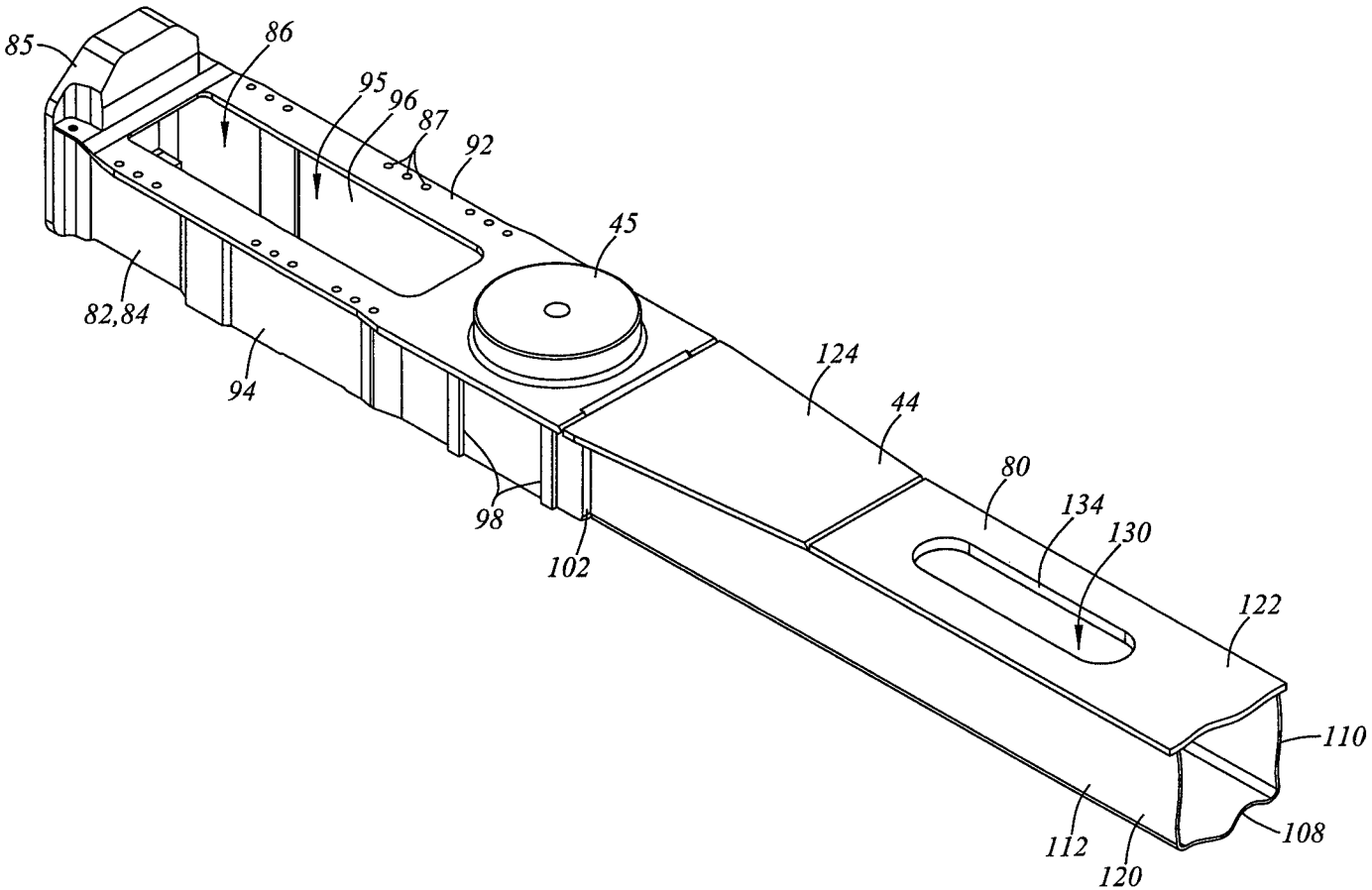
FIG. 3*b* shows an assembled isometric view of the elements of the center sill of FIG. 3*a;*
Figure 3D:
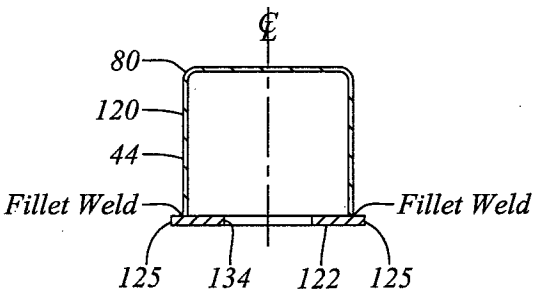
FIG. 3*d* shows a cross-sectional view of the center sill of FIG. 3*c* taken on section '3*d*-3*d';*
Figure 3C:
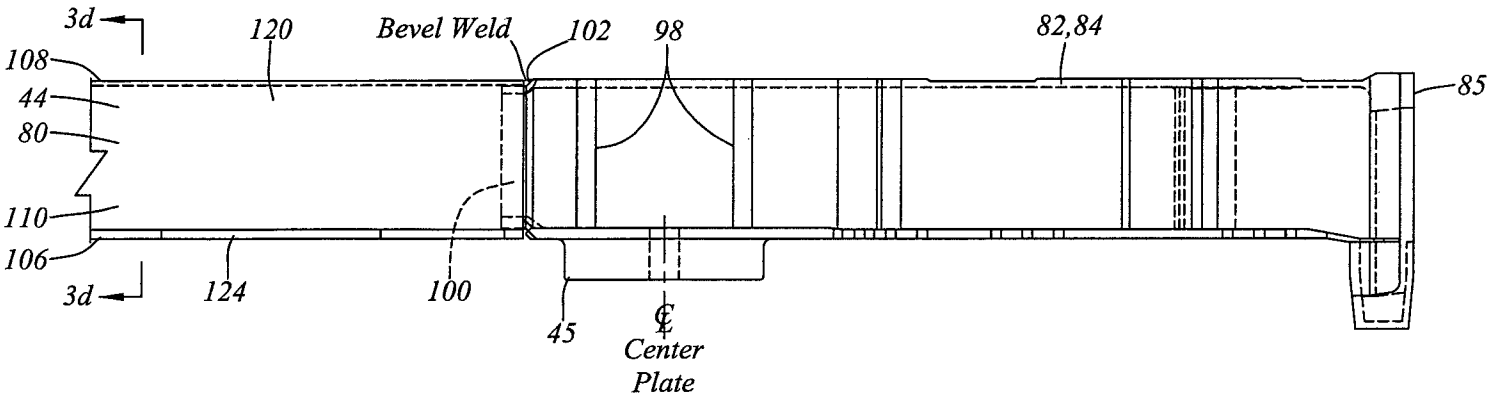
FIG. 3*c* shows a side view of the center sill elements of FIGS. 3*a* and 3*b;*
Figures 4A, 4B:
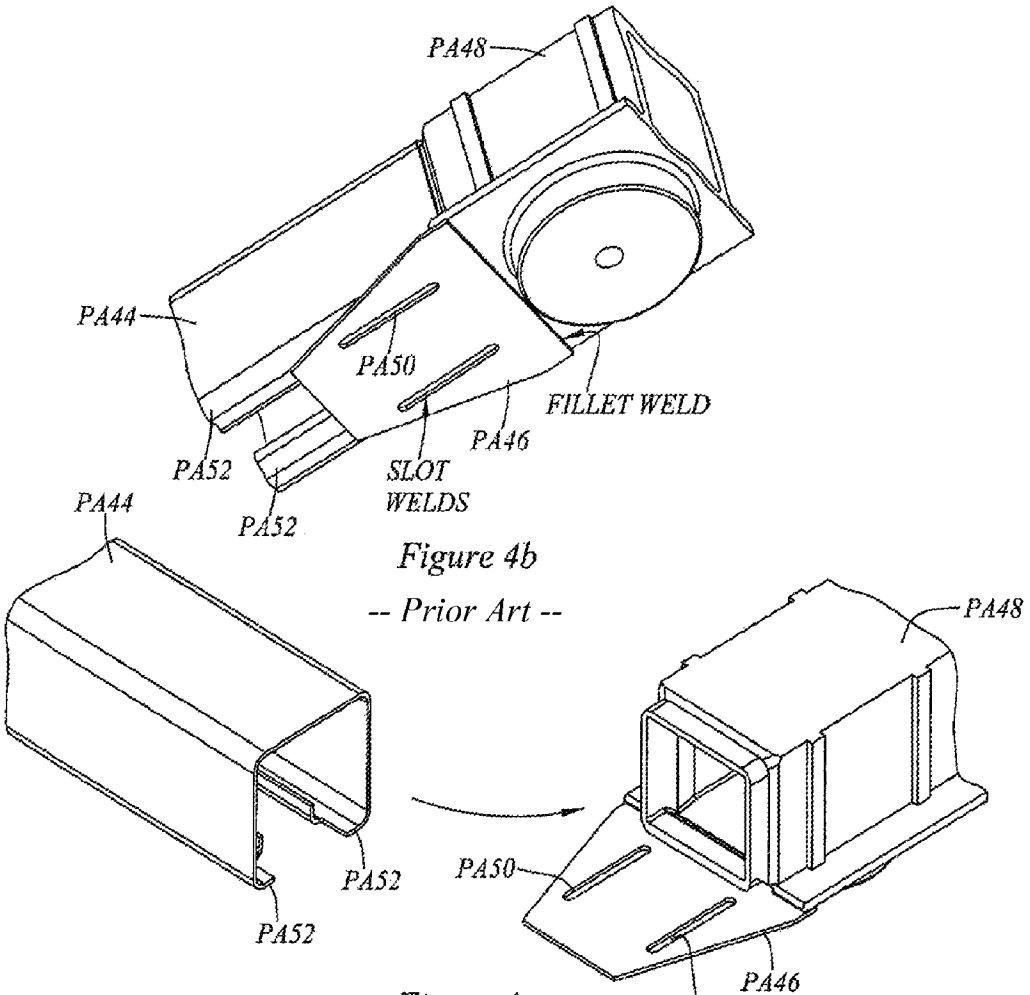
FIG. 4*a* shows a view of an alternate, prior art, design, the view corresponding to FIG. 3*a*.
FIG. 4*b* shows the alternate, prior art, design of FIG. 4*a* in an orientation corresponding to FIG. 3*b*.

The design of FIGS. 3*a* and 3*b* may be considered in light of the design of FIGS. 4*a* and 4*b* that involves the use of a roll-formed central portion of the center sill PA 44, and a doubler plate PA 46 that mounts under the roll-formed flanges PA 52 of the center sill intermediate portion and overlaps the end of the bottom flange of the draft arm PA 48 longitudinally inboard of the center plate. The transition from the narrow section to the wider section is achieved in the doubler plate PA 46. The doubler plate includes welding slots or apertures PA 50. Fillet or plug welds are made at apertures PA 50 to increase the area of weld over which the longitudinal load in the roll formed bottom flanges PA 52 of the roll formed center sill portion PA 44 is transferred into doubler plate PA 46. This approach may tend to yield (a) an out-of plane eccentricity in the longitudinal load path in the structure; and (b) an undesirable load concentration, if not a defect initiation site, in the join at apertures PA 50 in the doubler plate. This latter observation may also be considered in the context of a cold rolled single piece center sill having radiused corners, as illustrated in FIG. 4*a*. The effective flange width for forming a weld on the bottom flanges of this section is effectively reduced by these radii, as compared to a flat, full width (or slightly more than full width, where the side margins of the bottom flange extend transversely proud of the respective center sill webs) as in FIG. 3*a*. This joint is subject to large, fluctuating forces in both buff (compression) and draft (tension) on a repeated basis over the life of the car. In light of the lifetime load history that this connection may be expected to bear, the present inventor believes that the style of junction between the intermediate portion of the center sill and the draft arm shown in FIG. 4*a* may not be as advantageous as might be desired. By contrast, the design illustrated in FIGS. 3*a* and 3*b* provides an in-plane longitudinal stress flow path across the full width of the bottom flange of the center sill, and provides a relatively lengthy, and, in a stress field distribution sense, relatively smooth transition from the broader flange width $W_2$ of the bottom flange of the draft arm immediately longitudinally inboard of center plate 45 to the narrower center sill bottom flange width $W_1$ longitudinally inboard of internal bulkheads 62. It may also be that this design uses less material, and, in a stress field distribution sense, uses that material more efficiently without the stress concentration at PA 52 and without the stress field eccentricity. In some embodiments, transition plate 124 is a trapezoid, and is of a different through thickness than the adjoining main portion of the bottom flange of the center sill and the bottom flange of the draft arm. However, it may be convenient for plate 124 to be of the same thickness as plate 122. It may also be convenient for plate 122, plate 124 and bottom flange 92 longitudinally inboard of center plate 45.

Further, considering the central portion of the center sill bottom flange, the monolithic central portion may be made of a flat plate having an array, or string, of apertures 130 pre-cut therein. The apertures provide access to the inside if the center sill portion to permit the tub sheets to be secured directly to the center sill webs. That is, to the extent that mechanical fasteners are used, and a head of the fastener is mounted inside the center sill, apertures 130 provide installation (and replacement, if needed) access. Furthermore, the spanning webs, or bridges, 132 intermediate each pair of apertures 130 tie the two sides of the center sill bottom flange (and hence the bottom edges of the center sill webs together in a manner tending to maintain the geometric orientation of the flanges relative to each other in longitudinal buckling. This is unlike the continuous uninterrupted slot defined between the bottom flange halves of the roll formed central portion of center sill PA 44 of FIG. 4*a*, i.e., this tying feature is in the plane of the flanges generally, and is absent from the unitary roll-formed center sill section shown in FIGS. 4*a* and 4*b*. By way of example, each slot 134 may have a length of about 30" to 48", and may be about 3 ft long, and may have an end radius of about 3-4 inches, and each spaced web portion may have a length of about 8-16 inches, or about 1 ft, such that the ratio of open slots 134 to closed web bridges 132 is about 3:1, (+/−25%). In one embodiment there may be a single, long slot extending along the central portion and even into the transition, in part. The slot may terminate within perhaps as little as 12 to 18 inches of the center plate. In such an embodiment the center sill may have internal lateral stiffening gussets such as may act as lateral ties. In one embodiment, of course, there may be no slot. This kind of center sill is not restricted to use on bathtub gondolas, but may be used for other kinds of railroad cars having through center sills.

The stress field interruption, discontinuity, or singularity issue is also addressed in the alternative embodiment, as shown in FIGS. 5*a* to 5*d*. In these illustrations a center sill assembly 150 is shown in scab section, the illustration being truncated some distance, 4 or 5 ft (1-1.5 m, perhaps) inboard of the truck center. It will be understood that this is a through center sill that extends to the far end of the car, even though only one end is shown. Center plates 45 and bolster arms 54 may be understood to have the same geometry as before. However, in this instance center sill assembly 150 may include a channel section 152 that runs the full length of the car from striker to striker 154. This channel section may be an assembly of shorter U-pressings or roll formed pieces, assembled and welded in abutting end to end fashion, or it may be a monolith made from a single sheet of stock, whether pressed or roll formed. Channel section 152 may then have the appropriate inside width (e.g., 12⅞ inches) and height for receiving draft gear 156 and the shank of a coupler 158. The cross-section of channel section 152 may be taken as being the same as, or substantially the same as, that shown in FIG. 3*d*. As above, the U-shaped channel is mounted with its legs, or toes, extending downwardly, and its back oriented upwardly. As above, the back may be welded on continuous fillets to a floor sheet or floor assembly. Bottom flange 160 may be substantially the same as before in the central portion of the car, as at 162, and may include a widening transition 164 as it broadens from the narrow region to the broad region about and abreast of center plate 45 and at the roots of bolster arms 54. These portions may be of the same or different thicknesses. Center plate 45 is welded in place in the usual manner, and internal webs and gussets are mounted within channel section 152 above center plate 45 to provide web continuity across the center sill for the main bolster and to provide load spreading for the center plate loads. Bottom flange 160 may also have a bifurcated portion 166 longitudinally outboard of center plate allowing the introduction of draft gear 156 and having appropriate fittings, such as a suitable bolt hole pattern, for mounting a carrier plate 168, and such as aligned slots in the webs for mounting a coupler shank key 172 of coupler 158. In this example bottom flange 160 may be a monolithic part that has been cut to shape, and welded in place as described above. It may be monolithic from end to end, or merely may extend longitudinally inboard from the striker to the transition throat 174, or further inboard. Alternatively, it may be made of a series of plates butt welded together, such as one plate for the narrow section of the center sill, as above, a second plate for the transition trapezoid and the forked legs, or a second plate for the transition and separate legs for the outboard end. Whether monolithic or otherwise, the bottom flange need not be of a single thickness. For example, doublers may be welded on where greater thickness is desired, as in the outboard draft arm end of the assembly, indicated at 176. Alternatively, the flange may be made of thicker material longitudinally outboard of the wider end of the transition as indicated at 178. As above, the various components of the flange, be it a single component of a monolithic member or butt welded plates of two or more components, may be substantially co-planar as explained above, such that eccentricities or sudden discontinuities in geometry, and hence in the resultant stress fields, may be reduced or eliminated. For example, the toes of the channel may define a common datum for the upper surfaces of all of the bottom flange portions, compelling those upper surfaces to be co-planar. The use of a single straight through center sill channel of constant section that defines the side webs and top flange of the center sill may permit a significant reduction in fabrication effort. It may also permit better fit-up and consistency of dimensions, or reductions in the necessary allowance for dimensional tolerances, and consistency of structural properties. That channel may be monolithic (i.e., of single piece construction), or it may be an assembly of channels of the same cross-section, butted into each other end-to-end. In either case, there may be an improvement in consistency of dimension, smooth stress field transition, and in-service performance, and a reduction in fabrication effort. As before, this arrangement permits long, machine made welds of relatively high, consistent quality to be made between the bottom flange and the ends of the toes of the channel section.

Figure 5A:
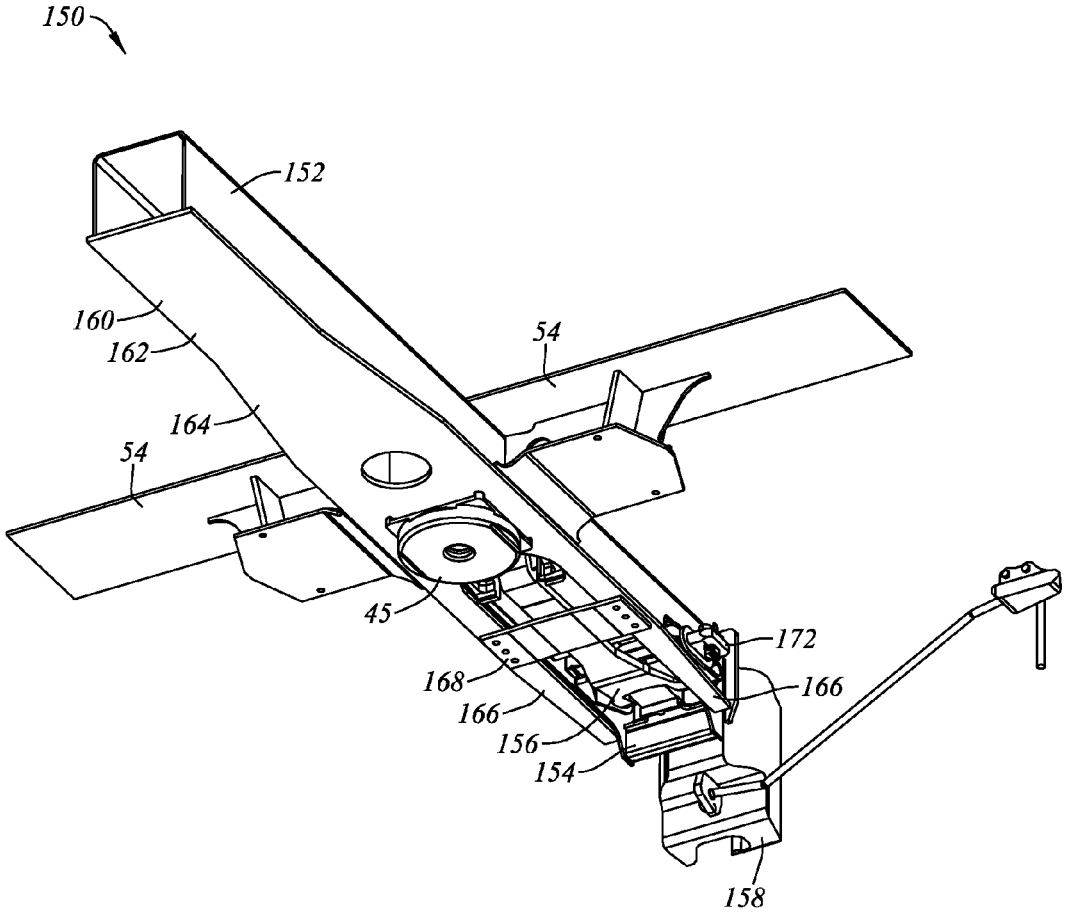
FIG. 5*a* is a perspective view of an alternate form of center sill and draft arm assembly to that of FIG. 3*b*, taken from one side, longitudinally inboard, and below.
Figure 5B:
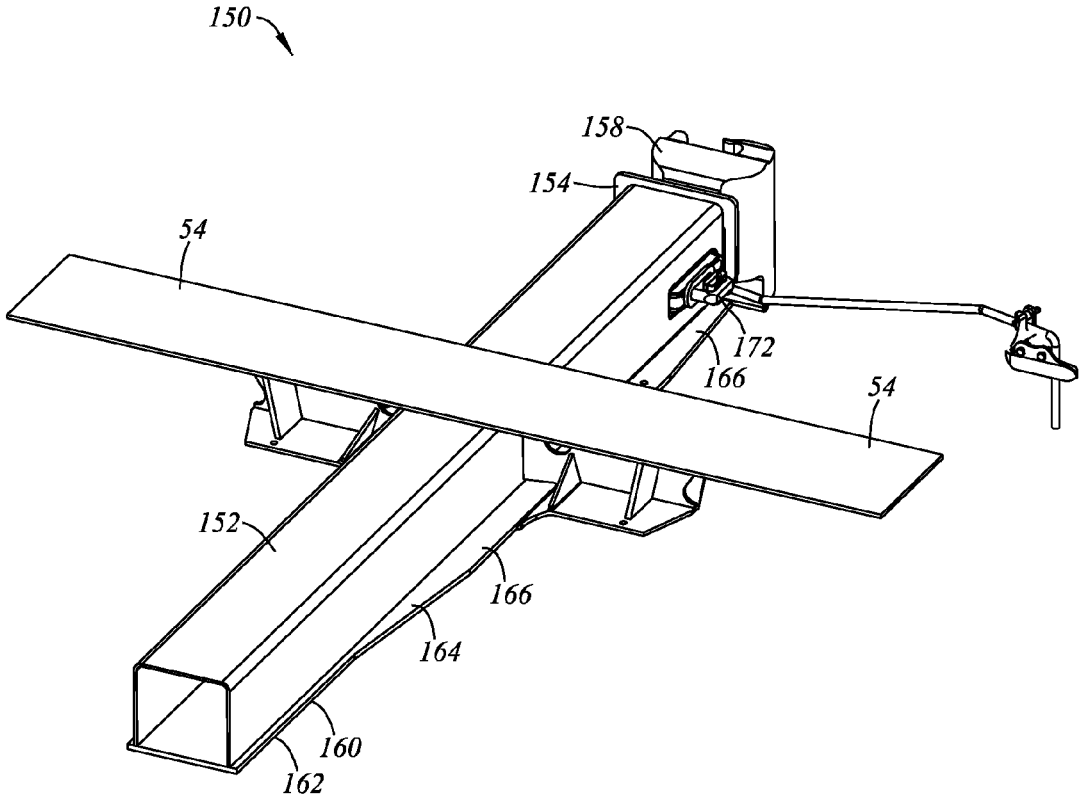
FIG. 5*b* is another perspective view of the center sill and draft arm assembly of FIG. 5*a* taken from longitudinally inboard, above, and to one side.
Figure 5D:
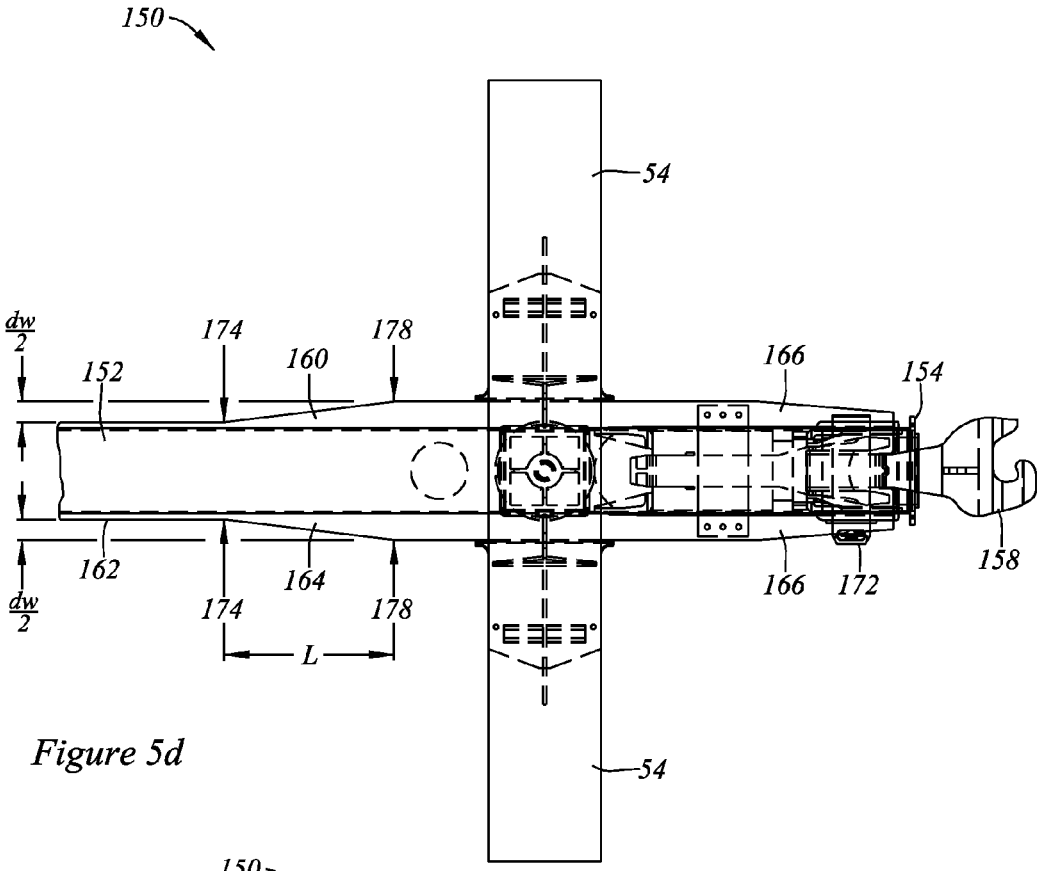
FIG. 5*d* is a top view of the assembly of FIG. 5*a*.
Figure 5C:
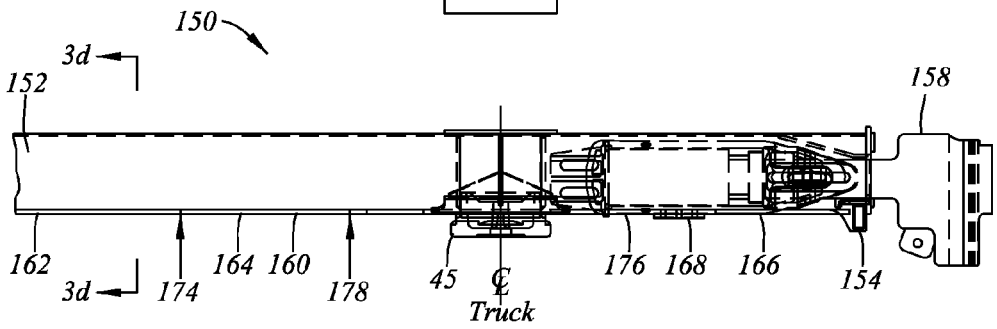
FIG. 5*c* is a side view of the assembly of FIG. 5*a*.

In either the embodiment of FIG. 5*a* or the embodiment of FIG. 3*b*, the length, L, of the transition plate or transition region may be in the range of 3/2 to 3 times the height of the channel section (i.e., the length of the legs). The length, L, of the transition section may be in the range of 3/2 to 4 times the width of the channel section measured across the outside of the webs. The length, L, of the transition section may be in the range of 2½ or 3 times to 4 or 5 times the increase in overall flange width, dW, of the bottom flange from the narrow end to the wide end, such that the stress field variation may be relatively smooth and gentle.

Various embodiments have been described in detail. Since changes in and or additions to the above-described examples may be made without departing from the nature, spirit or scope of the invention, the invention is not to be limited to those details.

The invention claimed is:

1. A center sill assembly for a rail road freight car, said center sill assembly comprising:

a first portion and a second portion;

said first portion including a draft arm in which to mount draft gear and a coupler;

said first portion having a top flange, a bottom flange, a first side web and a second side web, said top flange, bottom flange, and first and second side webs co-operating to define a substantially rectangular tube;

said draft arm having a first end and a second end, said second end of said draft arm having a striker plate thereat, said first end of said draft arm having an internal peripheral boss formed thereat, and said draft arm having a center plate mounted to said bottom flange thereof closer to said first end than to said second end, said internal peripheral boss extending lengthwise proud of said bottom flange at said first end of said draft arm;

said bottom flange of said draft arm having a continuous full width portion between said center plate and said first end, said full width portion having an extent $W_2$;

said second portion of said center sill assembly including a top flange, a bottom flange, a first side web and a second side web, said top flange said bottom flange, and said first and second side webs co-operating to define a substantially rectangular tube, said bottom flange including a main portion and a transition portion, said transition portion lying between said main portion and said bottom flange of said draft arm;

on assembly, said boss of said draft arm fitting within said substantially rectangular tube of said second portion of said center sill assembly, and said substantially rectangular tube of said second portion of said center sill assembly mating in abutting engagement with said first end of said draft arm;

said main portion having an overall flange width $W_1$, $W_2$ being greater than $W_1$;

said transition portion having a first end mating with said main portion, and a second end mating with said first end of said bottom flange of said draft arm, said transition portion widening from said main portion toward said draft arm;

said main portion of said bottom flange of said second portion of said center sill assembly, said transition portion of said bottom flange of said second portion of said center sill assembly, and said bottom flange of said first portion of said center sill assembly all being substantially co-planar, whereby an in-plane stress path is provided between said bottom flanges of said first and second portions of said center sill assembly.

2. The center sill assembly of claim 1 wherein said main portion of said bottom flange of said first portion of said center sill assembly, said transition portion of said bottom flange of said first portion of said center sill, and said bottom flange of said draft arm are all of the same thickness.

3. The center sill assembly of claim 1 wherein said main portion of said center sill assembly is of constant thickness.

4. The center sill assembly of claim 1 wherein said bottom flange of said main portion of said center sill assembly has margins extending transversely proud of said first and second side webs of said main portion.

5. The center sill assembly of claim 1 wherein said main portion of said bottom flange of said second portion of said center sill assembly has an array of access apertures formed therein to provide internal access to said center sill assembly between said first and second side webs.

6. The center sill assembly of claim 1 wherein said transition portion of said bottom flange has a length, L, and a change in width dW from the narrow end to the wide end, and a ratio of L:dW is greater than 3:1.

7. The center sill assembly of claim 6 where L:dW is one of (a) about 4:1; and (b) more than 4:1.

8. A railroad gondola car incorporating the center sill assembly of claim 1, wherein said car includes at least one lading containment tub running beside part of said second portion of said center sill assembly, and said tub has an arcuate bottom wall having a margin mechanically fastened to one side web of said second portion of said center sill assembly.

9. A rail road gondola car having a center sill and a pair of first and second side beams spaced to either side of said center sill and running parallel thereto, said gondola car having a pair of first and second tubs mounted to either side of said center sill, each tub running lengthwise parallel to said center sill, each tub having an arcuate bottom containment member, said arcuate bottom containment member having a margin attached by mechanical fasteners to said center sill; and said center sill having a bottom flange that has an array of access apertures formed therein by which to install said fasteners, said bottom flange also including an array of lateral bridging members.

10. The rail road gondola car of claim 9 wherein said access apertures have the form of slots having radiused ends.

11. The rail road gondola car of claim 9 wherein said array of access apertures include slots alternating with said lateral bridging members and a ratio of the combined length of said slots to the combined length of said lateral bridging members is approximately 3:1.

12. A center sill assembly for a rail road freight car, said center sill assembly comprising a U-shaped channel of constant cross-section, oriented with legs downward; and a bottom flange welded across said legs, said U-shaped channel extending both inboard and outboard of at least one center plate for seating on a rail road car truck, said bottom flange including a narrow portion, a wide portion, and a transition portion placed longitudinally between said wide portion and said narrow portion, said narrow portion, said wide portion and said transition portion being substantially co-planar.

13. The center sill assembly of claim 12 wherein at least two of (a) said narrow portion; (b) said wide portion; and (c) said transition portion are made from a single monolithic piece of stock.

14. The center sill assembly of claim 12 wherein said transition portion is of the same thickness as at least one of (a) said wide portion; and (b) said narrow portion.

15. The center sill assembly of claim 12 wherein said U-shaped channel has first and second ends, and a respective striker is mounted at each of said ends.

16. The center sill assembly of claim 12, said center sill assembly being part of a railroad freight car, and wherein at least one of (a) the bottom flange is a monolith from one end of the freight car to the other; and (b) the U-shaped channel is a monolith from one end of the freight car to the other.

17. The center sill assembly of claim 12 wherein said center sill assembly has a center plate mounted to said wide portion, and is intersected by a bolster abreast of said center plate.

18. The center sill assembly of claim 12 wherein said assembly includes an array of access apertures formed in said narrow portion of said bottom flange.

19. The center sill assembly of claim 12 wherein said center sill assembly is one in which any one of:

(a) said U-shaped channel is formed from a single monolith;

(b) said U-Shaped channel runs the full length of the car from striker to striker;

(c) at least two of (i) said narrow portion of said bottom flange; (ii) said wide portion of said bottom flange; and (iii) said transition portion of said bottom flange are made from a single monolith;

(d) said channel has internal webs providing web continuity for a main bolster across-said channel, and said bottom flange has a center plate fitting mounted thereto centrally with respect to said internal webs and said channel;

(e) said transition portion has a length L, that is between 1½ and 4 times the width of the channel measured across the outside of the channel legs;

(f) said transition portion has a length, L, that is between 1½ and 3 times the height of the channel;

(g) said transition portion has a length, L, that is between 2½ and 5 times the change in overall bottom flange width of the transition;

(h) said U-shaped channel has ends having slots formed therein to accept a coupler shank key;

(i) said bottom flange has a bifurcated portion longitudinally outboard of said center plate for accepting installation of draft gear therethrough, and fittings by which to attach a draft gear carrier;

(j) said channel has an internal dimension for receiving draft gear of standard AAR dimensions; and (k) said bottom flange has an array of apertures formed therein to provide internal access to said channel.

20. The center sill assembly of claim 19 wherein said assembly includes any combination of items (a) to (k).

21. The center sill assembly of claim 19 wherein said assembly includes all of items (a) to (k).

* * * * *